United States Patent [19]

Nemitz

[11] Patent Number: 4,510,353

[45] Date of Patent: Apr. 9, 1985

[54] METHOD AND KIT FOR CONSTRUCTION OF CUSTOM PROTOTYPE MEMBRANE SWITCH PANEL

[75] Inventor: Anthony R. Nemitz, Houston, Tex.

[73] Assignee: Arrow Display Company, Inc., Harris County, Tex.

[21] Appl. No.: 462,314

[22] Filed: Jan. 31, 1983

[51] Int. Cl.[3] ..... H01H 9/00; H01H 11/00; H01H 13/70

[52] U.S. Cl. ..... 200/5 A; 200/292; 206/223

[58] Field of Search ..... 361/398; 174/68.5; 200/5 R, 5 A, 159 B, 275, 292, 306, 11 TW; 206/223; 29/622

[56] References Cited

U.S. PATENT DOCUMENTS

| | | | |
|---|---|---|---|
| 3,860,771 | 1/1975 | Lynn et al. | 200/5 A |
| 3,886,335 | 5/1975 | Hendricks | 200/5 A X |
| 3,967,084 | 6/1976 | Pounds | 200/5 A X |
| 3,996,430 | 12/1976 | Eberwein et al. | 200/5 A |
| 4,035,593 | 7/1977 | Riniker | 200/5 A |
| 4,045,636 | 8/1977 | Yoder et al. | 200/5 A X |
| 4,046,975 | 9/1977 | Seeger, Jr. | 200/306 X |
| 4,066,851 | 1/1978 | White et al. | 361/398 X |
| 4,190,749 | 2/1980 | Erickson et al. | 200/11 TW |
| 4,287,394 | 9/1981 | Hargita et al. | 174/68.5 X |
| 4,303,811 | 12/1981 | Parkinson | 200/5 A |
| 4,365,408 | 12/1982 | Ditzig | 200/5 A X |
| 4,403,122 | 9/1983 | Wise | 200/5 A |
| 4,417,105 | 11/1983 | Glaser, Jr. | 200/5 A |

*Primary Examiner*—J. R. Scott

*Attorney, Agent, or Firm*—Carwell & Helmreich

[57] ABSTRACT

A custom prototype membrane switch panel, kit, and method for construction. Two membranes, an insulative spacer for use therebetween, and a plurality of conductive elements disposable between each membrane and spacer are provided. Spacer apertures in registry with the elements permit electrical contact therebetween upon displacement of one membrane toward the other. The elements are comprised of conductive ink bonded to an insulated backing in any desired geometric shape or shapes, and may be provided individually or plurally in sheet form separable therefrom for disposition between the spacer and membranes. Elements of different colors facilitate tracing different conductive paths created thereby in the resultant switch panel, and the backing automatically electrically insulates crossovers between the elements. One or more of the membranes or spacer has features, alone or in combination, of transparency, having a graphic grid network superimposed thereon, or being hingable to one or more remaining membrane or spacer, facilitating aforementioned registration.

30 Claims, 4 Drawing Figures

FIG. 3
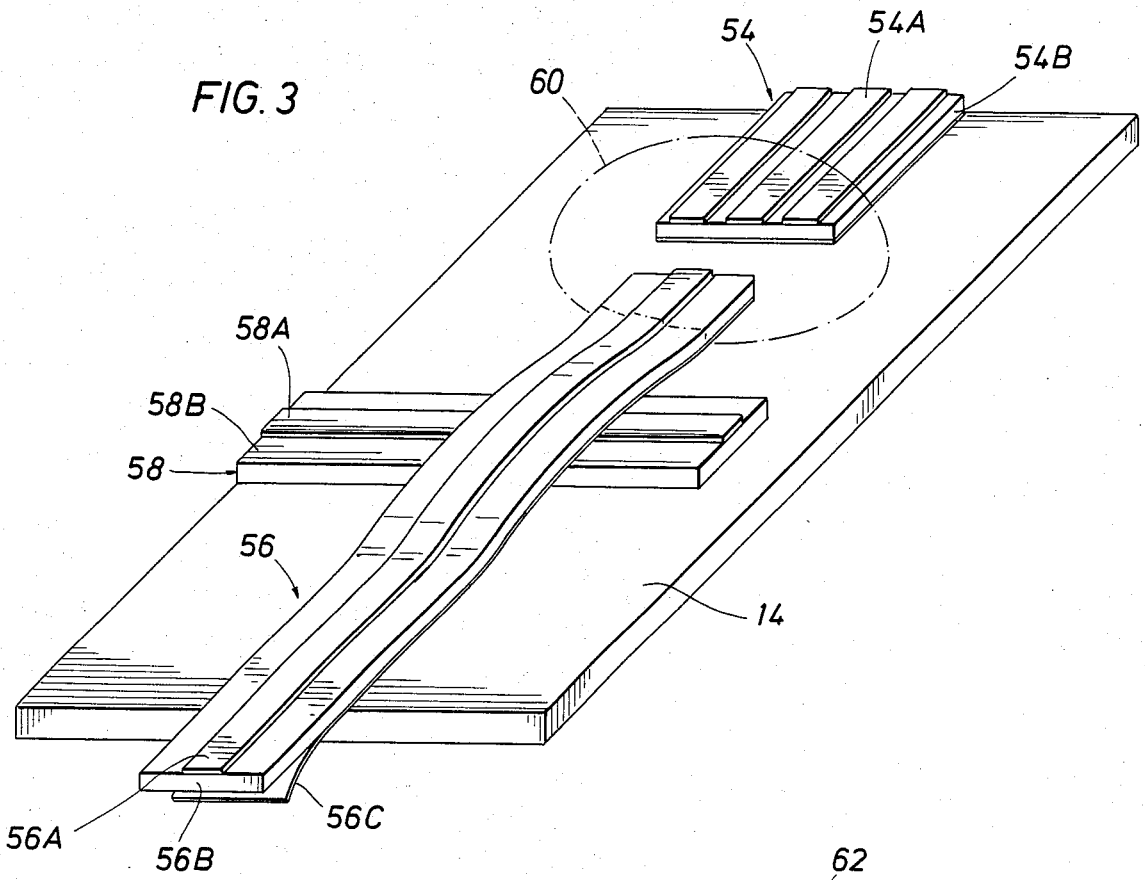
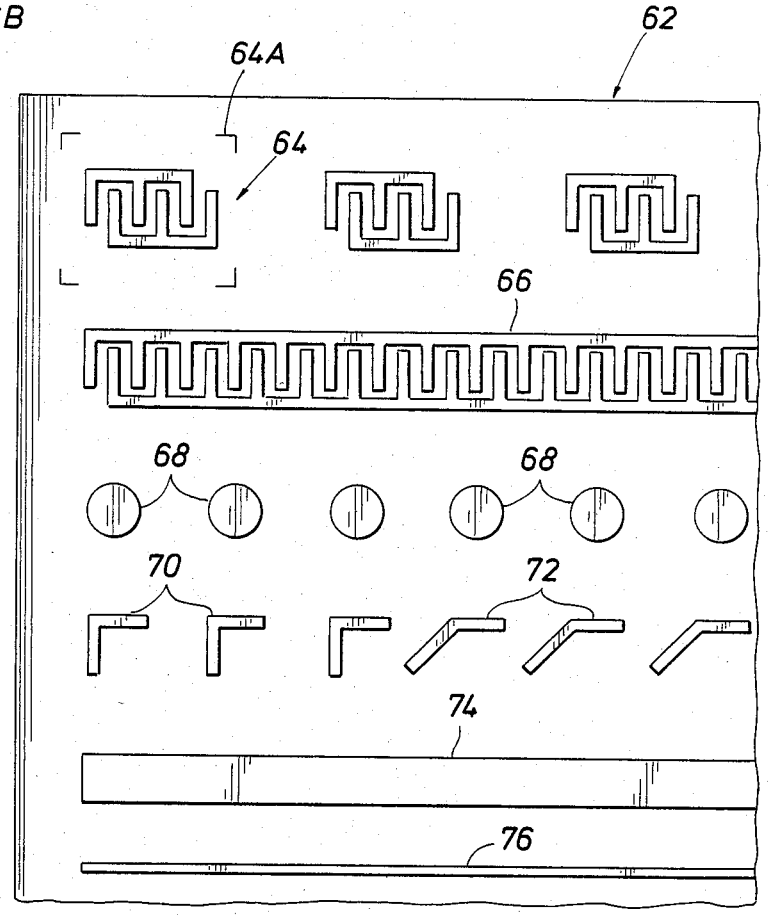
FIG. 4

METHOD AND KIT FOR CONSTRUCTION OF CUSTOM PROTOTYPE MEMBRANE SWITCH PANEL

BACKGROUND OF THE INVENTION

This invention relates to membrane switches, and more particularly, relates to custom prototype switch panels, kits, and methods for constructing such panels.

Membrane switches are often utilized due to their characteristic reliability and durability, low cost, superior resistance to deleterious environments, and the wide flexibility afforded the switch designer in tailoring a switch design to a particular application.

In order to capitalize on the flexibility afforded by membrane switches, it is frequently desirable to try a number of different switch designs, necessitating construction of a number of custom prototype switches. However, although the aforesaid cost savings may ultimately be obtained in large production runs, one serious problem with a decision to employ such switches is that initial cost for design and construction of a custom prototype membrane switch panel may be quite high, due to the time-consuming and costly steps required, including custom artwork, silk screening processes and the like. While these costs may in some instances even be prohibitive in the case of construction of one such prototype design, the problem is compounded all the more in the aforementioned case wherein numerous prototype designs are desired for testing, such that a designer is frequently precluded from availing himself of the outstanding benefit of flexibility of design uniquely associated with membrane switches.

Attempts have been made in the past to reduce the costs and time-consuming steps associated with production of custom prototype membrane switches. One such typical approach, disclosed in U.S. Pat. No. 4,303,811 to Parkinson, provides to the switch designer a kit containing materials required to produce a custom switch panel. More particularly, a plurality of pre-manufactured switch units, each with a varying number of membrane switches, is provided, and a transparent overlay. The switch unit or units having the desired number of switches is selected (or, if necessary, one is cut down in order to contain the required number). The overlay sheet is then placed over the resultant selection of switches which may then have affixed thereto custom graphic indicia adjacent the respective switches, resulting in a "custom" membrane switch panel prototype.

Numerous design constraints to such approaches have continued to plague the designer. One of the most serious is that while flexibility may have been afforded in the number and layout of switches in the panel, the designer is still limited to the switches and electrical interconnections provided in the switch units themselves, which have been pre-manufactured and preselected for inclusion in the kit.

Moreover, the problem still remains for the manufacturer of the switches and switching units to construct efficiently and provide to the designer a plurality of differing switching and circuit configurations for his use which, as previously noted, can become quite expensive due to the numerous layout and screening process steps and the like.

One such problem in making switch elements and other conductive paths for inclusion in the membrane switch is that of insuring proper registery between the apertures in the insulative spacer separating the upper and lower membranes, and the conductive elements carried on either side of the spacer between the membranes.

Various techniques are employed in layout of artwork for the layers in a membrane switch to attempt to provide registry therebetween, such as use of transparent artwork layouts, layouts having coordinate grids, and registration pins. In the latter case, for illustration, a plurality of stable verticle registration pins may be provided mounted, e.g., in a layout board, and each layer of artwork is provided with mating holes in the edge thereof. In this manner, as successive layers of layout artwork are overlaid in the holes brought into mating registry with the pins, vertical registry will hopefully be maintained in the artwork with respect to any of the layers.

Whereas this approach may be attempted for maintaining registry in large commercial or production runs of switch panels, it will be noted that the artwork thus generated and registered is only an intermediate step, and must be utilized (often in further photographic reduction processes, or the like) in production of final layers which will comprise the membrane switch by techniques known in the art such as silk screening, printing methods, various methods for production of printed circuit boards, or the like. Thus, the occasional designer of custom prototype switches, particularly in the case wherein elaborate layout facilities such as those of membrane switch manufacturers are not available, is still faced with the problem of producing both quickly and inexpensively a very limited quantity of custom design prototype membrane switches which are nevertheless comparable with those commercially available from manufacturers in terms of accuracy of registration, reliability, and the like.

Yet another problem faced by the custom membrane switch designers is that even if they are somehow efficiently able to maintain registration tolerances offered by commercial switch manufacturers, providing custom conductive parts or elements on a limited prototype or non-production basis in a membrane switch can be extremely time consuming when conventional techniques are employed.

As but one example, it is frequently necessary to provide for such conductive paths between the spacer and a membrane. Conventional methods include the etching of conductive traces on the face of printed circuit boards which serve as the switch membranes. However, this necessitates photographic and other steps in order to produce the desired circuit path configurations. Methods and apparatus were thus highly desirable for providing custom conductive paths for use between the spacers and membranes wherein the conventional numerous steps required to produce such paths were substantially reduced, including steps required to provide insulation between conductive paths which cross one another.

These disadvantages of the prior art, including those of the aforementioned U.S. Patent, are overcome with the present invention, and commercially acceptable embodiments of a custom prototype membrane switch panel, kit, and method for construction of same are herein provided which are fully capable of not only providing improved registration between the various layers in a custom prototype membrane switch, but further provide for total design flexibility with respect to the conductive paths provided between each outer membrane and the insulative separator layer disposed therebetween.

SUMMARY OF THE INVENTION

This invention is for methods and apparatus in kit form for construction of a custom prototype membrane switch panel as well as the resultant switch panel constructed thereby. Membranes formed of plastic sheet or the like are provided having an insulative separating spacer disposed therebetween. Between each membrane and the spacer conductive paths are provided. One or more apertures in the spacer provide for intercommunication between at least portions of the conductive paths between each membrane and the spacer, whereby inward deflection of a membrane towards the remaining membrane causes electrical interconnection between the paths on either side of the spacer through the aperture.

In one particularly ideal embodiment of the present invention, at least two of the three layers (comprised of the two membranes and spacer making up the switch panel) are hinged on the edges or otherwise registerable by means of hinges or pins and holes in their edges in mating registry therewith, as in the form of a booklet, for example. Conductive elements or paths of a form to be later hereindescribed are thereafter disposed between each membrane layer and the spacer whereby, upon depression of one of the membranes, the aforementioned electrical interconnection in registry through the spacer apertures is assured.

At least one of the membranes or the spacer is transparent in this embodiment preferably. If one of the membranes or the spacer is transparent, by looking through the membrane to the spacer, or, alternatively, looking through the spacer to the inner surface of the membrane, the designer is able to see how conductive elements carried by the inner surface of the membrane register with apertures in the spacer.

In another ideal embodiment of the present invention, a grid or other convenient graphic form for locating planar locations, such as a series of dots of known X-Y coordinates, is provided on, for example, the outer two membranes, whereby placement of the conductive elements on each membrane in a manner to be described will be such that they will align in the desired vertical registry when stacked horizontally on top of one another in construction of the switch panel. Like grids or other planar locators may be provided on the spacer whereby apertures therethrough may be made in registry with any of the aforementioned conductive elements disposed on the inner surfaces of the membranes. It may also be preferable to include the aforementioned hinging feature in conjunction with the planar locators to further enhance registry of the conductive elements with the spacer apertures.

The conductive elements are provided in the form of electrically conductive areas formed of a material such as conductive ink carried by bonding or the like by a relatively non-conductive base material such as plastic. The elements may be of any desired planar geometrical configuration desired, such as lines forming conductive traces, or "wires", switch pads, or the like. Moreover, the configurations or designs may be provided separately or in the form of a sheet of such traces, all of which may be identical or of different geometries, and, in particular, may contain all components necessary to construct, for example, a five position switch.

Adhesive material may be provided on any of the membrane's inner surfaces or on one or both of the surfaces of the spacer, or under the insulative base material of the conductive elements for permanently positioning the conductive elements on the membranes or spacer for mounting when transferred thereto. In a typical embodiment, one set of switch contacts or "fingers" will be placed and aligned on the inner surface of a membrane or on one side of the spacer. This will be accomplished by means of the aforementioned grids on the membrane surface or spacer surface (or by checking registry with spacer apertures by means of hinging or transparency of the membrane or spacer, or both as hereinbefore described). Mating switch pads will be placed on the opposite side of the spacer again by similar means of adhesion, either on the spacer itself or the inner side of the other membrane, and aligned (again, by means of the grids, hinging, transparency, or combinations thereof) so as to permit communication through the spacer apertures (either precut or custom cut) to cause electrical connection between the switch pads on the other side of the spacer and the fingers upon inner deflection of one of the membranes. The base material of the conductive elements is of a relatively non-conductive or insulative material whereby, when it is desired to provide, between a particular membrane and the spacer, conductive paths which cross over one another and are insulated therebetween, the insulation is thereby automatically provided due to the insulative base of each of the conductive elements. Moreover, each of the conductive elements, including those of a linear format forming conductive wires, may be provided having plastic insulative bases of differing colors whereby, when they are placed on a particular membrane or separator surface, and particularly when there is a significant amount of the aforementioned overlapping or crossing of of the conductive paths, the ability to trace conductive paths on the particular membrane or spacer surface is thereby significantly enhanced. Still further a conductive ink may be provided which may be placed between the conductive portions of two or more elements and which will provide, upon drying, electrical interconnection therebetween.

Accordingly, it is a feature of the present invention to provide method and apparatus, in kit form, for improved construction of custom prototype membrane switch panels, as well as improved custom prototypes switch panels thereby constructed.

It is another feature of the present invention to provide a kit and method for providing a custom prototype membrane switch panel wherein improved flexibility, efficiency, and cost reduction in the switch design is achieved.

It is yet another feature of the present invention to provide methods and apparatus for providing a custom prototype membrane switch panel wherein improved registry between the various switch layers is effected.

It is still a further feature of the present invention to provide methods and apparatus for constructing custom conductive pads and elements in a membrane switch layer.

Yet a further feature of the present invention is to provide for facilitating the tracing and interconnection of electrical circuits and the conductive paths of a membrane switch layer.

These and other features and advantages of this invention will become apparent from the following detailed description, wherein reference is made to the Figures in the accompanying drawings.

IN THE DRAWINGS

FIG. 3 is a pictorial representation depicting placement of conductive elements on a layer of a switch panel of the present invention.

FIG. 4 is a schematic representation of representative geometric configurations of conductive elements of the present invention.

DETAILED DESCRIPTION OF THE INVENTION

Figure 1:
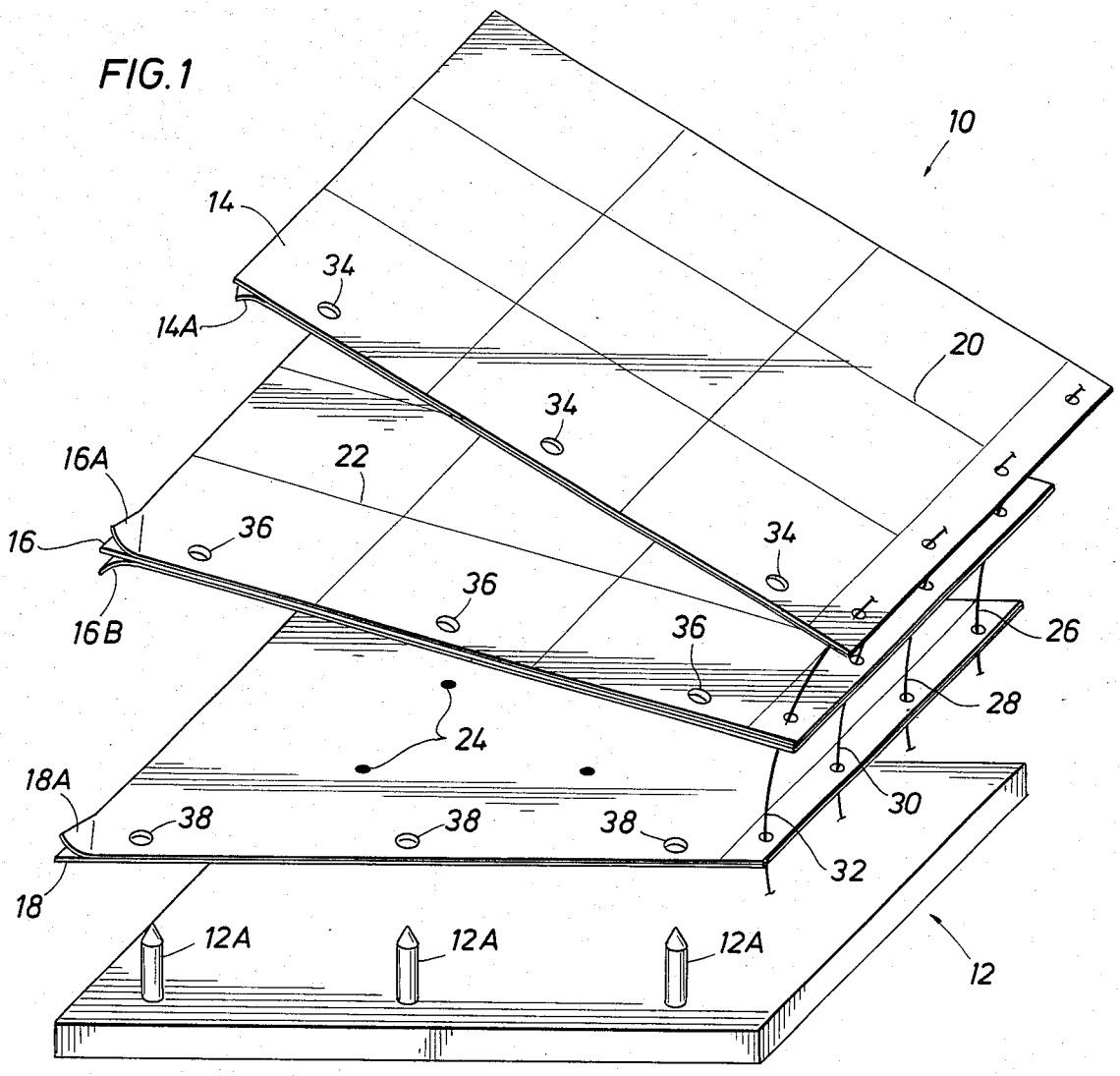
FIG. 1 is a pictorial representation of a portion of a switch panel of the present invention.

Referring first to FIG. 1 there will be seen a switch panel assembly 10 of the present invention in exploded view and a representative layout board 12, which may be backlighted if desired, upon which the assembly 10 may be registered in a manner to be described. Regarding switch panel 10 in more detail, it will be seen to be comprised of an upper membrane 14, an insulated separator or spacer 16, and a lower membrane 18, all fashioned of some form of sheet plastic material well known in the art. Referring to the upper membrane 14, it will preferably be of a transparent or translucent material and may have disposed on one surface thereof a printed grid 20 for purposes which will hereinafter be made clear. Also, there may be disposed through the upper membrane 14 a plurality of registration apertures 34. A membrane backing **14*a* may be provided, preferably also of a transparent material, which may cover up an adhesive layer on the underside of the surface of the upper membrane 14 during construction of the desired switch, such that when it is desired to seal the various switch layers together or to place conductive elements on the underside of upper membrane 14, this membrane backing 14*a*** may be peeled off to expose the adhesive surface.

With respect to the spacer 16, reference to FIG. 1 will reveal that it may also preferably be provided with a grid 22 printed thereon and registration apertures 36 which may be placed in vertical alignment with apertures 34 of upper membrane 14. Also in like manner to upper membrane 14, there will be seen an upper and lower spacer backing **16*a* and 16*b*, respectively, which serve to cover layers of adhesive material residing on the upper and lower surfaces of spacer 16, and which may be peeled back in like manner to membrane backing 14*a*** to expose the respective adhesive layers for purposes which will later be described.

Referring now to the lower membrane 18, for purposes of illustration there have been depicted therein a matrix or plurality of dot patterns 24. It is desirable to locate points on the planes formed by membranes 14, 18, and the spacer 16 which will be in vertical alignment when placed together to make up a switch panel assembly 10. Accordingly, depiction of the dot pattern 24 on the lower membrane 18 is only for purposes of indicating that a number of graphic indicators or planar locators may be provided on the surfaces of membranes 14, 18, and spacer 16 for purposes of facilitiating the interrelating of any point on a horizontal plane formed by one of the membranes or spacer with that of a point on any other horizontal plane formed by a remaining membrane or spacer, such that when the membranes and spacers are assemblied in vertical alignment, as indicated by assembly 10, the points on the various planes or surfaces of the membranes 14, 18, and spacer 16 will be in vertical alignment or registry.

Figure 2:
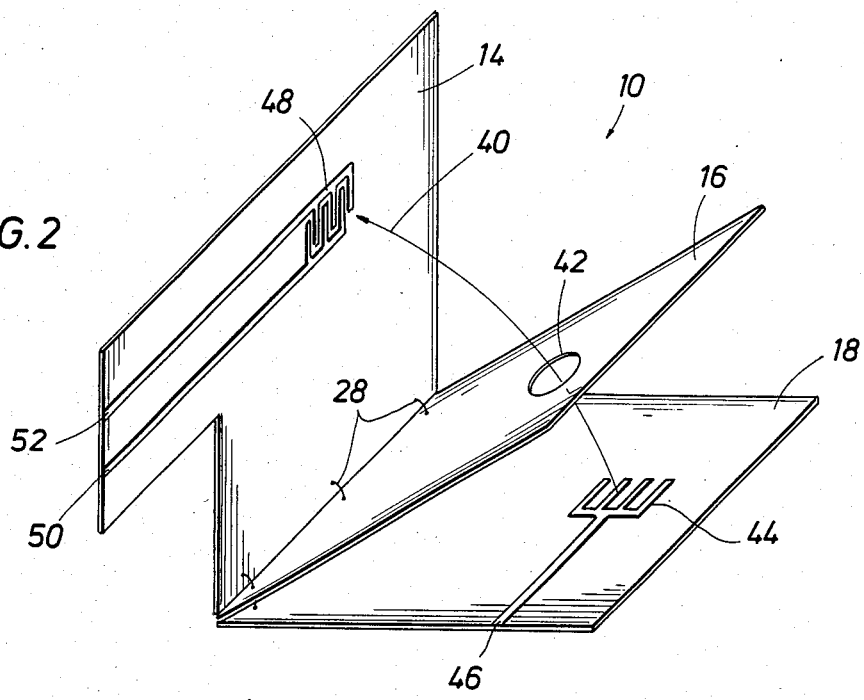
FIG. 2 is a pictorial representation of another switch panel of the present invention.

Still referring to FIG. 1, it will be noted that hinging may be provided between any two or all three of the membranes 14, 18, and spacer 16, as illustrated by hinges 26, 28, 30, and 32, thus enabling the membranes 14, 18, or spacer 16 hinged thereby to be able to move in booklet form with respect to the remaining membranes or spacer with which they are hinged, in a manner depicted in FIG. 2 for purposes which will become readily apparent. This hinging may be either in the form of loose hinges provided in a membrane kit for attachment in a desired manner to the membranes and/or spacer, or, in the alternative, the various membranes 14, 18, and spacer 16 may be pre-hinged as shown in FIG. 1.

The aforementioned layout board 12 may be provided with registration pins **12*a* such that when the various membranes 14, 18, and spacer 16 are lowered onto the layout board 12 in a manner so as to cause registration between the pins 12*a* and the registration holes 34, 36, and 38 of the respective membrane 14, spacer 16, and lower membrane 18, each of the membranes and spacer will thereby be prevented from moving horizontally with respect to any remaining membrane or spacer. In this manner, it will be appreciated that the registration pins 12*a* and registration holes 34, 36, and 38 may provide the same function as the hinges 26, 28, 30, and 32, in the sense that the various layers formed by the membranes and spacer may be folded backwards and forwards or opened as in booklet form without disturbing the relative horizontal positioning of the membranes and spacer when they are lying on top of one another. This will permit cross checking between the various layers to see if there is vertical registry between conductor elements and apertures in spacer 16** to be described.

Referring now to FIG. 2, the switch panel assembly 10 of the present invention may be seen with the planar locators (grids, dot matrix, etc.) removed for purposes of clarity. However, in the view of FIG. 2, there will be seen additional elements omitted from FIG. 1 again for purposes of clarity, namely, in general, inclusion of conductive elements 44 and 48, and a spacer aperture 42.

It will be recalled that the fundamental operation of a basic membrane switch is as follows. An upper and lower membrane 14 and 18 are provided at least one of which is flexible to some extent and an insulative separator or spacer 16 disposed between the membranes 14 and 18, said spacer 16 having one or more apertures 42 extending therethrough. One or more conductive elements is provided between membrane 14 and spacer 16 (depicted in FIG. 2 as conductive element 48) and, in like manner, one or more conductive elements 44 is disposed between the lower membrane 18 and spacer 16. The assembly 10 is thence brought into alignment to form the switch wherein membranes 14 and 18 and spacer 16 are brought together so as to cause the surfaces thereof to lie in co-planar fashion horizontally parallel to one another. One method of doing so depicted in FIG. 2 is to cause the membranes 14 and 18 to rotate about hinges 28 inwardly in the directions of arrow 40 in a manner not unlike that of closing a book.

When the membranes 14, 18, spacer 16, and conductive element 44 and aperture 42 are thus disposed, provided the conductive elements 44, 48, and aperture 42 are in vertical alignment, it will be appreciated that conductive element 48 may be made to be disposed in vertical registration over conductive element 44 but electrically separated from contact therewith through aperture 42 by means of the spacing provided by spacer 16. Upon depression of membrane 14 inwardly towards membrane 18 or vice-versa in the area surrounding aperture 42, due to the aforesaid flexibility thereof the respective conductive element 44 or 48 may be caused to be flexed or displaced sufficiently through aperture 42 to contact the remaining one of conductive elements 44 or 48, so as to bring said elements into electrical contact with one another.

A close inspection of FIG. 2 will reveal that the electrical contact points 50 and 52 are electrically isolated from one another due to the separation of fingers of conductive element 48 prior to the aforementioned movement of one the conductive elements 44 or 48 through the aperture 42 to contact the respective remaining conductive element. However, upon such electrical interconnection between the conductive elements 44 and 48 in the manner thus described, it will be seen that the electrically conductive fingers associated with contact 52 and 50 will be shorted across one another by the corresponding fingers of conductive element 44 whereby the contact points 50 and 52 are thereby brought into electrical contact with one another, e.g., closing of the switch contacts 50 and 52 is thereby effected. It will further be appreciated that upon operation of the switch of assembly 10 in the aforementioned manner, the electrically conductive fingers of conductive element 44 on one side of spacer 16 will be brought into electrical contact with the fingers of conductive element 48, and thus the contact point 46 on one side of spacer 16 is brought into electrical contact with the contact points 50 and 52 on the opposite side of spacer 16.

Referring now to FIG. 3 it will be readily apparent that depending upon the particular application wherein a switch panel assembly 10 of the present invention is desired, it would be highly desirable to provide conductive paths and elements between the membranes 14 and 18 and the spacer 16 which are in any desired configuration, and it is a feature of the present invention to provide for such flexibility in the custom design of such conductive paths to be described hereinafter in more detail. For the present, however, it will be sufficient to note that one means for providing such conductive paths is to provide for a wide variety of conductive elements in a variety of shapes and sizes for adhesive placement on the membranes 14, 18, or separator 16.

Thus, still referring to FIG. 3 in more detail, there may be seen depicted therein conductive elements 54, 56, and 58 residing on a membrane 14, in like manner to those depicted in FIG. 2. Referring to conductive element 56 for the moment, it will be noted that such elements are preferably provided in accordance with the teachings of the present invention in the form of a conductive surface element **56*a* of conductive ink, for example, bonded by printing or the like to an insulated backing 56*b* underneath which may be provided preferably an additional backing 56*c*. When a conductive path is desired, as in the case of FIG. 3, for example, from the edge of membrane 14 to some location on the membrane surface, a conductive element such as 56 may be selected and, in some cases, as hereinafter described, separated from a sheet containing a plurality thereof, and the backing 56*c* peeled off and thus removed from the remaining insulated backing 56*b* and conductive trace 56*a*. An adhesive layer may be provided on the lower or undersurface of insulated backing 56*b*, protected by the backing 56*c*, such that upon removal of the backing 56*c*, the conductive element 56 may be press-fit and thus adhered to the surface of the membrane 14, 18, or separator 16**, thus laying out the desired conductive path.

It will be recalled that in an alternative embodiment, the inner surfaces of one or more membranes 14 and 18 and/or one or both sides of the separator 16 may, in like manner, be provided with adhesive surfaces and protective peel-back coverings if desired. In this manner, the adhesive backing of conductor elements such as conductor element 56 and the protective backing **56*c* for the adhesive layer may be obviated, in that the conductive elements such as elements 56** may be caused to adhere to the adhesive surfaces of the membranes or separator sheet in any desired fashion.

Still referring to FIG. 3, another feature of the present invention may be seen depicted therein. It will be noted that the conductive element 56 has been caused to crossover a like conductive element 58 also having a conductive trace or strip **58*a* which is bonded to an insulative backing 58*b* correlative to backing 56*b* of conductive element 56. Due to provision of the insulated backings such as 56*b* and 58*b*, whenever a conductive element such as element 56 is routed so as to crossover a conductive trace such as 58*a* of another conductive element, insulation is thereby automatically provided between the two conductive traces 56*a* and 58*a*. In conventional approaches, when such crossovers were desired, it was necessary to first insulate the upper surface of the conductive trace such as 58*a* at the point of crossover by means of a small piece of plastic insulative sheet or a drop of liquid material which would dry into an insulative covering or the like. Additional routings of conductive paths such as that provided by conductor element 56 would then be provided over conductor element 58 by means of printing the conductive paths on membrane 14, 18, or separator 16** or by means of routing conductive tape about the surfaces thereof. Such steps were often time consuming and resulted in unreliable switch circuitry, particularly in dense switch wiring applications.

Still referring to FIG. 3, yet an additional conductive element 54 may be seen depicted therein, having on the upward surface thereof a conductive trace such as **54*a* fashioned of a conductive ink such as silver ink or the like, with such traces being bonded to an insulative substrate backing 54*b* in like manner to the other conductive elements. The purpose of depicting conductive elements 54 and 56 together is to indicate that, in accordance with the present invention, when such conductive elements are provided separately and there is a need to assure the integrity of electrical connections therebetween with respect to their respective conductive traces such as 56*a* and 54*a*, this may be accomplished by means of a conductive ink. More particularly, a liquid conductive ink such as silver ink or the like may be provided whereby the ink is "painted" from one end of conductive trace 56*a* to one end of conductive trace 54*a* (schematically represented by ink dot 60), whereby when the ink dries a conductive bridge is formed thereby electrically interconnected conductive trace 54*a* and 56*a*. It will thus be seen that by provision of insulated conductive elements of varying geometric configurations having conductive traces on the surface thereof which may be interconnected by means of the aforesaid ink, wide flexibility is afforded in the design and fashioning of any desired custom electrical circuit configuration between membrane 14 or 18 and the separator 16, only but one example thereof being given with respect to FIG. 2**, wherein a simple switch is shown.

Referring now to FIG. 4, again in keeping with the teachings of the present invention, it is contemplated that a wide variety of pre-printed conductive elements may be provided for disposal between the membrane 14 or 18 and separator 16, a few of which are shown depicted in FIG. 4. These conductive elements such as those shown generally as conductive elements 62 of FIG. 4 may be provided separately. However, in the alternative, it is contemplated that a plurality of such conductive elements may be provided which are preprinted on a single sheet and easily separable from the sheet, and it is further contemplated that all of the conductive elements may either be identical in function and geometric configuration or different to provide for flexibility in the selection thereof by the circuit designer.

With respect to the latter situation, it is further contemplated that it may be desirable to provide a preprinted sheet or sheets containing all of the necessary components to fabricate a custom prototype switch panel of a predetermined type. For example, such a sheet may be printed up having all of the conductive elements required to construct a switch panel having, for purposes of illustration, one single position switch, two three position switches, and a "bar" switch wherein the area on the membrane 14 or 18 which must be depressed for actuation of the switch is in the form of an elongate surface area.

Thus, still referring to FIG. 3 and the various configurations of conductor elements 62, there will first be seen a top view of the conductor tracings of a conductor element known as switch fingers 64. It will be noted that regardless whether the conductor elements 62 depicted in FIG. 4 are provided separately or are in the form of sheets wherein they may be individually detached therefrom, it is desirable to provide tic marks (such as 64*a* with respect to conductor element 64) about the conductor tracings of the particular conductive element. The purpose of these marks 64*a*, which may be sized to correlate with grid spacings such as that of grid 20, 22, or dot matrix 24 of FIG. 1, is so that the particular conductive elements 62 may be easily aligned on the particular membrane 14, 18, or spacer 16 surface in a desired orientation horizontally on the surfaces formed thereby so as to insure vertical registration as well as neat and accurate layouts.

Still referring to FIG. 4, yet another geometric arrangement of the conductive traces of a conductive element 62 may be in the form of an elongate arrangement of a bar switch finger 66. Such a conductive element 66 may be disposed between the spacer 16 and one membrane, and a correlative bar switch pad 74 disposed in vertical registry between the opposite membrane and spacer 16, and an aperture such as aperture 42 of FIG. 2 may be further provided (of a more elongate shape similar to that of bar switch pad 74), whereby one of the membranes 14 or 18 may be depressed at any point along the elongate aperture formed in the spacer 16 so as to effect contact between bar switch finger 66 on one side of the spacer 16 and bar switch pad 74 on the opposite side of the spacer 16. Thus, it will be seen that a switch may thus be created which is not unlike that of an elongate space bar of a conventional typewriter. In passing, it will be noted that in like manner to the conductive element known as a bar switch pad 74, a conductive element in the form of switch pad 68 may be utilized in conjunction with switch finger 64 in like manner to the switch finger 66 and switch bar 74 combination to construct a smaller switch. In the latter case, the switch pad 68 may be used to replace, for example, conductive element 44 depicted in FIG. 2.

It will be apparent that the elongate conductive traces such as 54*a*, 56*a*, and 58*a* of FIG. 3 may be seen schematically depicted as conductive element 76 in FIG. 4. These conductive elements serve the purpose of conductive wires in conventional electrical circuitry. As such, it is contemplated that such elongate conductive element 76 would be utilized most frequently in many applications of the present invention, and consequently, it is envisioned that in a kit for production of a custom prototype membrane switch of the present invention, numerous such conductive elements 76 would be provided in various lengths (which, of course, may also be trimmed to a desired length). It is further to be expected that in layouts of many desired circuits between membranes 14 and 18 and separator 16, it will be desirable to route conductive tracings at certain angles, and therefore short conductive elements such as 70 and 72 depicted in FIG. 4 may be provided for interconnection with conductive elements such as 76, for example, by means of the aforesaid conductive ink so as to provide flexibility in routing conductive traces in other than straight lines. While only a few geometric patterns have been depicted in FIG. 4 for conductive elements 62, the present invention admits of conductive elements to be provided in any desired geometrical configuration and thus it is not intended to limit the scope of the present invention to the geometrical configurations depicted in FIG. 4.

Yet another feature of the present invention is to provide for conductive elements 62 in varying colors. For example, it is desirable to provide elongate conductive elements 74 or 76 wherein either the conductive traces or supporting insulating layers thereunder are color-coded. The purpose of this is so that it is easy to trace conductive paths about the faces of membranes 14, 18, or spacer 16, particularly when crossovers occur, or to facilitate tracing of interconnections from a conductive path on one side of the spacer 16 with such a path on the other side. As but one example, it will be appreciated that if conductive element 58 is of one color and conductive elements 54 and 55 are of a different but identical color, it is easy to trace on the surface of membrane 14 (even through a transparent spacer 16) the conductive path of conductive elements 54 and 55 over conductive element 58.

With respect to spacer 16, typically a mylar film in the range of 5–14/thousandths of an inch in thickness is appropriate in most applications, the thicker the material the more actuation pressure being required to operate the switch. It is contemplated that a plurality of pre-punched spacers 16 may be provided each having a different arrangement of a plurality of conveniently located apertures 42 and being of different thicknesses, depending upon the switch design.

Similarly, the membranes 14 and 18 may typically be of a polyester or polycarbonate plastic film composition with a nominal thickness in the range of 0.12 mm–0.17 mm, although one of the membranes may, for example, even be a conventional printed circuit board.

Moreover, any of the membranes 14, 18, or spacer 16 may be provided with a matte finish on either or both sides thereof. The purpose of such finish may be not only to reduce glare, but to permit receiving of pencil or other temporary graphic markings for circuit layout or the like.

The registration pins 12*a* and corresponding registration holes 34, 36, and 38, while shown on one side of the respective layers 14, 16, and 18 of the switch assembly 10, may be placed in any convenient location and may be of any convenient number. For example, if one of the registration pins 12*a* is of a non-circular cross-section (such as in the form of a cross) only one registration pin and corresponding registration hole in each layer 14, 16, and 18 may be required for registration if the aforesaid holes are of the same cross-sectional shape as the pin. With respect to such registration, it will be noted that the aids to registration of the conductive elements in the subject invention, namely the pins and holes, hinging, transparency, and grids, may be utilized alone or in any combination.

Several details in conventional membrane switches have been omitted simply for purposes of clarity. For example, there has been no discussion of graphic overlays which are typically provided over the upper membrane 14 and contain indicia on the face thereof to indicate positioning of the switches located therebelow. In like manner, there has been no detailed indication of interconnection or interface between the various switching and other circuitry contained in switch assembly 10 and any correlative circuitry with which it is associated. For example, it is conventional to provide output termination to the switch assembly 10 in the form of direct soldering to terminals such as 50 and 52 of FIG. 2, or to provide the tab adjacent terminals 50, 52 in the form of a conventional printed circuit board edge tab for plug-in type connection to a corresponding female PCB tab connector to which is attached a conventional ribbon cable or the like. Such details will, of course, be included in a practically feasible embodiment of the invention.

With reference now to typical steps of construction of a switch panel assembly 10 of the present invention, with to FIG. 1, membranes 14 and 18 may preferably be clear or semi-transparent and have the aforementioned respective grids 20 or dot matrices 24 disposed thereon. Moreover, the upper membrane 14 will have no adhesive layer and consequently the backing 14*a* is not required. However, the lower membrane 18 will preferably have an adhesive layer underneath and consequently a protective backing such as 18*a* will be provided on the lower surface of membrane 18 but will not be required on the upper surface. The purpose of such an adhesive layer is to rigidly affix the resultant switch assembly 10 to a desired location on a chassis or the like.

With respect to spacer 16 in a typical assembly 10 and method of construction, it will preferably be provided with an adhesive surface on either side thereof. The protective backings 16*a* and 16*b* will moreover preferably be transparent or semi-transparent and may also have grids if desired. In the alternative, if the protective backings 16*a* and 16*b* are opaque, it is desirable to provide for grids such as 22 on the backing 16*a* and 16*b* on both sides of the spacer 16. In this manner due to presence of grids on membranes 14 and 18 and transparency of spacer 16, and backing 16*a* and 16*b*, or, alternatively, with the presence of grids 22 on unclear backings 16*a* and 16*b*, it will be appreciated that any point on the surface of one of the elements 14, 16, or 18 may be related to that of any remaining element to insure vertical registration thereof.

In the typical switch and switch kit embodiment and method of making same, it is further preferable to provide the hinging 28 between all three layers 14, 16, and 18, or, in the alternative, to provide for hole and pin registration of all three layers. In the general method of laying out a switch having the components just described, first shorting pads such as conductive elements 68, after removing the backing protecting the adhesive layer, may be placed on the upper surface of membrane 18 in any desired location, although preferably tic marks 64*a* will be utilized to place these pads or any other conductive element 62 in alignment with the dot matrix 24 or grid 20 on membrane 18.

Next, spacer 16, if of the transparent variety, may be placed over membrane 18 in registry therewith by means of the registration pins and holes or the hinging. Due to the transparency of spacer 16, location of the shorting pads 68 on membrane 18 may be seen and marked on the spacer 16, and apertures such as 42 then punched by means of a hand die or the like through the spacer 16 at the location of the switch pads 68. In the alternative, if opaque backings 16*a* and 16*b* for the spacer 16 are provided, the grids such as 22 marked thereon may be utilized to locate the appropriate positions on spacer 16 for the aforesaid apertures 42 by correlating the locations on spacer 16 by means of the grids 22 with the locations of the switch pads on membrane 18 due to the correlation between the grids or matrices on membrane 18 with those of spacer 16.

Next, conductive elements must be located on the upper membrane 14 such that when the membranes 14, 18, and spacer 16 are vertically aligned, registry is obtained between the conductive elements on upper membrane 14, the apertures such as 42 just punched in the spacer 16, and the switch pads resident on the lower membrane 18. Accordingly, by referring to the location of the apertures 42 in the grid 22 on the spacer 16, any desired conductive elements may be located on upper membrane 14 so as to be in registry with the apertures by using the co-related grids 20 and 22 on upper membrane 14 and spacer 16, respectively. Moreover, even without such grids 20, due to the transparency of upper membrane 14 and the registry between membrane 14 and spacer 16 afforded by registration and pin holes or the hinging 28, it is possible to overlay the upper membrane 14 over the spacer 16 to note where the conductive elements must be placed on upper membrane 14 to be in registry with the apertures 42 disposed through spacer 16. The conductive elements 62 may be placed on upper membrane 14 in like manner to placement of the switch pads on lower membrane 18, e.g, by first removing the adhesive backing of the particular conductive element 62 and affixing it to the upper membrane 14. It will further be noted that any additional desired circuitry wherein registration is not required through the apertures may then be placed on the inner surfaces of upper and lower membranes 14 and 18 in any desired fashion by utilizing the conductive elements 62 or the like such as those depicted in FIG. 4. When all of the circuitry has thus been affixed to the inner faces of upper and lower membranes 14 and 18, the protective backings 16*a* and 16*b* may thence be removed and all three layers 14, 16, and 18 press-fit together so as to seal off the circuitry inwards of the edges of the membranes 14, 18, and spacer 16 from the ambient environment.

The present invention admits to numerous embodiments wherein the various features of grids, transparency, registration holes, hinges, and the like are used in various combinations. For example, membranes 14 and 18 may be opaque, and have adhesive layers and grids on their inner surfaces and spacer 16 may also be opaque with grids on either side thereof and no adhesive surfaces. Conductive elements may thus be placed on the inner surfaces of membranes 14 and 18, and by utilizing the grid on spacer 16, appropriate apertures 42 may be placed in spacer 16 to register with the conductive elements on membranes 14 and 18. Alternatively, although membranes 14 and 18 may be opaque, spacer 16 may be transparent so as to permit viewing through spacer 16 to the conductive elements on membrane 14 and/or 18 to determine where to place the apertures 42 for registry therewith.

In yet another illustrative embodiment, only upper membrane 14 or lower membrane 18 may be transparent whereby when the transparent membrane is laid on the spacer 16, due to the transparency any conductive element residing thereon may be viewed to see where appropriate apertures must be placed in the spacer 16. As a corollary to this embodiment, only membranes 14 and 18 may be transparent so that they may be placed over one another to insure that conductive elements placed on their inner surfaces will be in vertical alignment, such that either membrane 14 or 18 may thereafter be laid vertically over spacer 16 to permit determination where apertures must be punched on spacer 16 for vertical registry with the conductive elements on membranes 14 and 18.

In still another illustrative embodiment, only upper membrane 14 and spacer 16 or, in the alternative, lower membrane 18 and spacer 16 may be transparent. In this manner, not only is it possible to check registry between the conductive elements on the outer transparent membrane, either 14 or 18 with the apertures in the separator 16, but, moreover, it is thence possible to view through the two transparent layers to insure that the apertures and the conductive elements on the transparent membrane are in registry with the correlative conductive members on the non-transparent membrane.

It is therefore apparent that the present invention is one well adapted to obtain all of the advantages and features hereinabove set forth, together with other advantages which will become obvious and apparent from the description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and material composition of its components, as well as in the details of the illustrated construction, without departing from the scope of the and spirit thereof.

What is claimed is:

1. A membrane switch comprising:
- an upper membrane;
- a lower membrane;
- a spacer disposed between said upper and lower membranes and defining an aperture therethrough;
- a first conductive path disposed between said spacer and said upper membrane;
- a second conductive path disposed between said spacer and said lower membrane;
- at least a portion of one of said first and second conductive paths moving through said aperture and into electrical contact with the other of said first and second conductive paths upon relative inward displacement of one of said membranes toward the other of said membranes; and wherein
- at least a portion of said first conductive path is comprised of:
  - a first conductive element disposed between said spacer and said upper membrane and comprising:
    - a first insulative base; and
    - a first conductive trace bonded to and forming an integral part of said first insulative base prior to said first conductive path being disposed between said spacer and said upper membrane.

2. The switch of claim 1, wherein at least a portion of said second conductive path is comprised of a second conductive element disposed between said spacer and said lower membrane and comprising:
- a second insulative base and a second conductive trace bonded to and forming an integral part of said first insulative base prior to said first conductive path being disposed between said spacer and said upper membrane.

3. The switch of claim 2, wherein said base or said trace of said first conductive element is of a color different from said base or said trace of said second conductive element.

4. The switch of claim 1, wherein said first conductive element is one of a plurality of conductive Paths adhesively and removably disposed upon a sheet and transferred from said sheet to between said spacer and said upper membrane.

5. The switch of claim 1, wherein said upper and lower membranes and said spacer each define an outer edge, and wherein said edges are in co-alignment and hinged together when said spacer is disposed between said membranes.

6. The switch of claim 1, wherein at least two of said upper, lower membranes and said spacer each define an outer edge having at least two registration holes disposed therethrough matingly registerable when said spacer is disposed between said membranes.

7. The switch of claim 1, wherein at least one of said upper, lower membranes, and said spacer includes a plurality of grid lines disposed thereon.

8. The switch of claim 7, wherein said plurality of grid lines are disposed on said upper and lower membranes.

9. The switch of claim 1, wherein said upper and lower membranes includes grids disposed thereon, and wherein said spacer includes an adhesively coated surface disposed on both sides thereof prior to said spacer being disposed between said membranes.

10. A kit capable of being assembled into a prototype membrane switch comprising the combination of:
- an upper membrane;
- a lower membrane;
- a spacer adapted to be disposed between said upper and lower membranes and to receive an aperture therethrough;
- a first conductive element adapted to be disposed between said upper membrane and said spacer; and
- a second conductive element adapted to be disposed between said lower membrane and said spacer, at least one of said first and second conductive elements comprising an insulative base and a conductive trace bonded to said base prior to said disposing of said at least one of said first and second conductive elements between said upper or lower membrane and said spacer, respectively.

11. The kit of claim 10, including a pre-printed sheet having a plurality of conductive elements including said at least one of said first and second conductive elements separable from said sheet said conductive elements being adapted to be disposed between said upper or said lower membrane and said spacer.

12. The kit of claim 11, wherein at least two of said plurality of conductive elements each have geometrically differing respective conductive traces.

13. The kit of claim 12, wherein said geometrically differing conductive traces comprise at least two traces depicted in FIG. 4.

14. The kit of claim 10, wherein said at least one conductive element includes an adhesive layer disposed on said insulative base.

15. The kit of claim 10, wherein said at least one conductive element comprises two or more conductive elements each having a different color.

16. The kit of claim 10, wherein at least one conductive element comprises:

two or more conductive elements for disposition betweeen said spacer and one of said upper lower membranes; and wherein said kit further includes conductive ink means for electrically connecting said conductive traces of said two or more conductive elements.

17. The kit of claim 10, wherein at least either one of said upper or lower membranes has a planar locator disposed thereon and wherein said at least one of said first and second conductive elements includes tic marks on said insulative base for aligning said at least one conductive element with said planar locator.

18. The kit of claim 10, wherein said kit includes registration means for aligning in vertical registration at two elements of the group comprising said first and second conductive elements and said aperture in said spacer.

19. The kit of claim 18, wherein said registration means comprises a registration pin; and a registration aperture for slidingly mating engagement with said pin disposed in at least two of said group.

20. The kit of claim 18, wherein said registration means comprises at least one hinge means interconnecting said at least two of said group for hinged interconnection between at least two of said group along their respective edges.

21. The kit of claim 20, wherein said hinged interconnection is between said upper and said lower membranes and said spacer.

22. The kit of claim 10, wherein at least one of the group comprising said upper and lower membranes and said spacer includes a planar locator.

23. The kit of claim 22, wherein said upper and lower membranes include grids disposed thereon.

24. The kit of claim 10, wherein the inner surface of at least one of the group comprising said upper and lower membranes and said spacer includes a matte surface finish.

25. The kit of claim 10, wherein said spacer is transparent.

26. The kit of claim 25, wherein said spacer includes first and second co-planar and opposite surfaces having adhesive layers disposed thereon; and respective first and second removable backing adhering to said adhesive layers; and wherein said spacer and said first and second backings are transparent.

27. The kit of claim 10, wherein at least two of the group of said upper and lower membranes and said spacer are transparent.

28. The kit of claim 10, wherein said upper and lower membranes and said spacer are transparent.

29. A method of constructing a membrane switch comprised of:

an upper membrane;

a lower membrane;

a spacer disposable therebetween and having an aperture therethrough;

a conductor; and a plurality of conductive elements comprising a pre-printed sheet of conductive elements each having a differing geometric configuration and each being comprised of an insulative base removably adhered to said sheet and a conductive trace bonded to said base; said method comprising the steps of:

disposing said spacer between said upper and lower membranes;

disposing said conductor between said spacer and said lower membrane and adjacent said aperture in vertical alignment therewith;

preselecting at least one conductive element from said pre-printed sheet;

transferring said at least one conductive element from said sheet to a location adjacent said aperture and disposed between said upper membrane and said spacer whereby when said upper membrane is displaced toward said lower membrane, electrical contact is made through said aperture between a portion of said plurality of conductive elements and said conductor.

30. A membrane switch comprising:

an upper membrane;

a lower membrane;

a spacer disposed between said upper and lower membranes and defining an aperture therethrough;

a plurality of conductive elements disposed between said upper membrane and said spacer; and a conductor disposed between said lower membrane and said spacer whereby when said upper membrane is displaced toward said lower membrane adjacent said aperture, electrical contact is made through said aperture between a portion of said plurality of conductive elements and said conductor; said plurality of conductive elements being selected from a pre-printed sheet of conductive elements each having a differing geometric configuration and being comprised of an insulative base removably adhered to said sheet; and a conductive trace bonded to said base; and wherein one of said plurality of conductive elements is disposed across at least one other of said plurality of said conductive elements and between said at least one of said plurality of conductive elements and said spacer.

* * * * *